United States Patent [19]

Chapotier

[11] Patent Number: 4,815,985

[45] Date of Patent: Mar. 28, 1989

[54] PREFABRICATED ELECTRIC CONNECTION DEVICE FOR CONNECTION TO A SET OF BARS

[75] Inventor: Daniel J. Chapotier, Senlis, France

[73] Assignee: Fournitures Electro Techniques, Saint Just en Chaussee, France

[21] Appl. No.: 44,941

[22] PCT Filed: Jul. 31, 1986

[86] PCT No.: PCT/FR86/00272

§ 371 Date: Mar. 31, 1987

§ 102(e) Date: Mar. 31, 1987

[87] PCT Pub. No.: WO87/00979

PCT Pub. Date: Feb. 12, 1987

[30] Foreign Application Priority Data

Jul. 31, 1985 [FR] France ..... 85 11720
Apr. 17, 1986 [FR] France ..... 86 05549

[51] Int. Cl.[4] ..... H01R 25/16

[52] U.S. Cl. ..... 439/212; 174/72 B; 361/361

[58] Field of Search ..... 439/110–122, 439/207–216; 361/361; 174/71 B, 72 B

[56] References Cited

U.S. PATENT DOCUMENTS

| | | | |
|---|---|---|---|
| 2,824,901 | 2/1958 | Reichert et al. | 174/72 B |
| 2,871,285 | 1/1959 | Fouse et al. | 174/72 B |
| 2,946,928 | 7/1960 | Slade | 439/212 |
| 3,267,336 | 8/1966 | Kussy et al. | 361/361 |
| 3,339,038 | 8/1967 | Jorgensen et al. | 200/50 R |

FOREIGN PATENT DOCUMENTS

| | | |
|---|---|---|
| 1284699 | 1/1961 | France . |
| 1370463 | 10/1974 | United Kingdom . |

*Primary Examiner*—Gary F. Paumen
*Attorney, Agent, or Firm*—Wenderoth, Lind & Ponack

[57] ABSTRACT

A prefabricated electric connection device includes a set of bars which extend parallel to each other. Intermediate connection members each provided with an external insulating sleeve are fixed to respective ones of the bars and extend forwards perpendicularly to the bars. The bars are drilled with aligned holes through which extend, with interposition of the insulating sleeves, the intermediate connection members fixed at their rear ends to the bars situated behind a first bar.

7 Claims, 3 Drawing Sheets

PREFABRICATED ELECTRIC CONNECTION DEVICE FOR CONNECTION TO A SET OF BARS

BACKGROUND OF THE INVENTION

The present invention relates to a prefabricated electric connection device for connection to a set of bars.

There are generally used for the distribution of electric energy distribution cabinets containing sets of bars associated with the respective phases and to which are connected devices of the utilizers for ensuring the protection of respective circuits. The main drawbacks of known connection devices are that they require time consuming operations to be connected to a utilizer apparatus and that they are of high wiring cost.

SUMMARY OF THE INVENTION

An object of the present invention is to overcome these drawbacks by providing a connection device of particularly simple structure whereby the connection of a utilizer apparatus is considerably simplified and may be carried out in a short period of time.

For this purpose, this prefabricated electric connection device for connection to a set of bars extending parallel to one another, is characterised in that the bars, which are parallel to one another and are separated by air gaps, are located one behind the other in a direction perpendicular to the planes of the bars. Intermediate connection elements, each provided with an external insulating sheath, are respectively fixed to the bars and extend forwardly perpendicular thereto. The bars are provided with aligned holes, and the intermediate connection elements are at their rear ends to those bars located at the rear of a first bar and extend through such holes in those bars. The front end of the intermediate connection element fixed to the first bar, and the front ends of the intermediate connection elements fixed to the other bars are all located in front of the first bar in the same plane perpendicular to the bars.

The holes provided in the bars have such a diameter that they do not substantially alter the cross section of the bars so that they value of the allowable intensity in the bars is only very slightly affected by the presence of the holes.

According to an additional characteristic of the invention, the front ends of the intermediate connection elements are advantageously contained in the same plane parallel to the planes of the bars.

The invention also provides protection devices for protecting against short-circuit currents, particularly in electric energy distributing installations.

The utilizer devices are generally connected to connection cabinets containing sets of bars associated with the respective phases of the network through protection devices.

The protection devices of house or plant circuits are calculated to ensure protection against short-circuit surges produced in the network, for example following an accidental short-circuit produced by the breakdown of a utilizer device, by considering the paths of the current in the connections of the distribution cabinet as short circuit paths having no impedance.

Consequently, the protection devices, such as circuit breakers, must be designed to withstand very high currents, which requires a corresponding dimensioning of the component elements, in particular of the conductors and the moving elements, arc extinguishing mens and other devices.

The electric connection device of the type defined hereinbefore has a surprising property in addition to the fact of being of a particularly simple construction relative to known connection devices and also simplifying connecting operations between the network and the utilizer apparatus.

Indeed, it has been found that this connection device, when it is connected between the network and a utilizer device, performs the function of a short-circuit current limiter.

The invention therefore also provides an electric connection device of the type defined hereinbefore, characterised in that it constitutes a limiter of excessivre currents.

BRIEF DESCRIPTION OF THE DRAWINGS

There will be described hereinafter, by way of a non-limiting example, an embodiment of the present invention with reference to the accompanying drawings, in which.

DETAILED DESCRIPTION OF THE INVENTION

Figure 1:
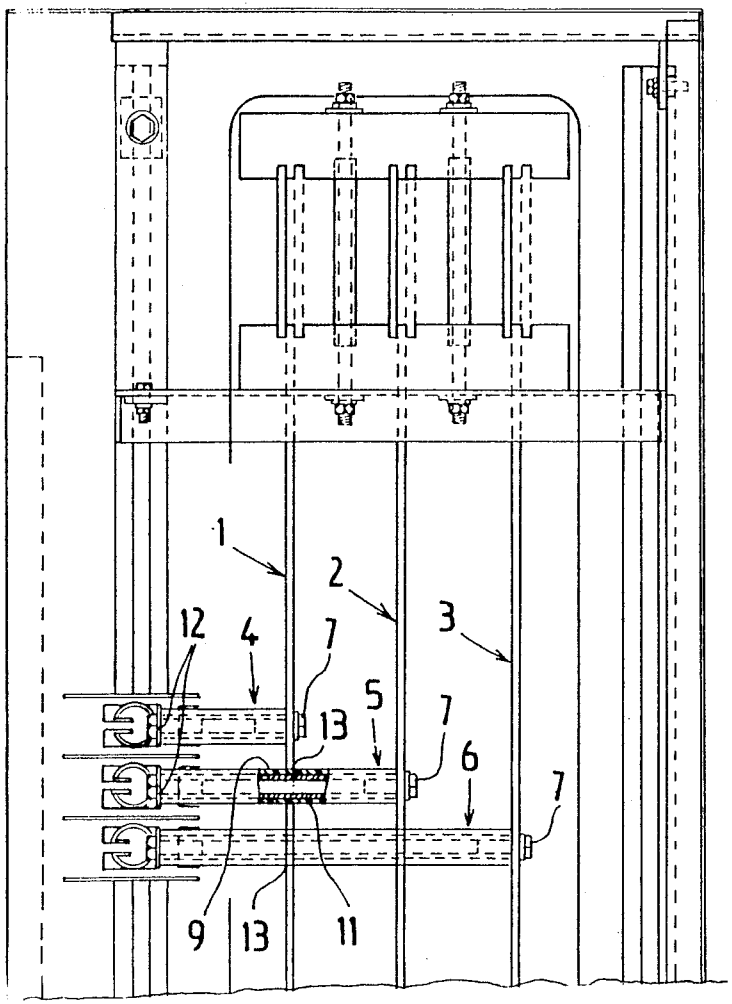
FIG. 1 is a side elevational view of an electric connection device including a set of bars according to the invention.
Figure 2:
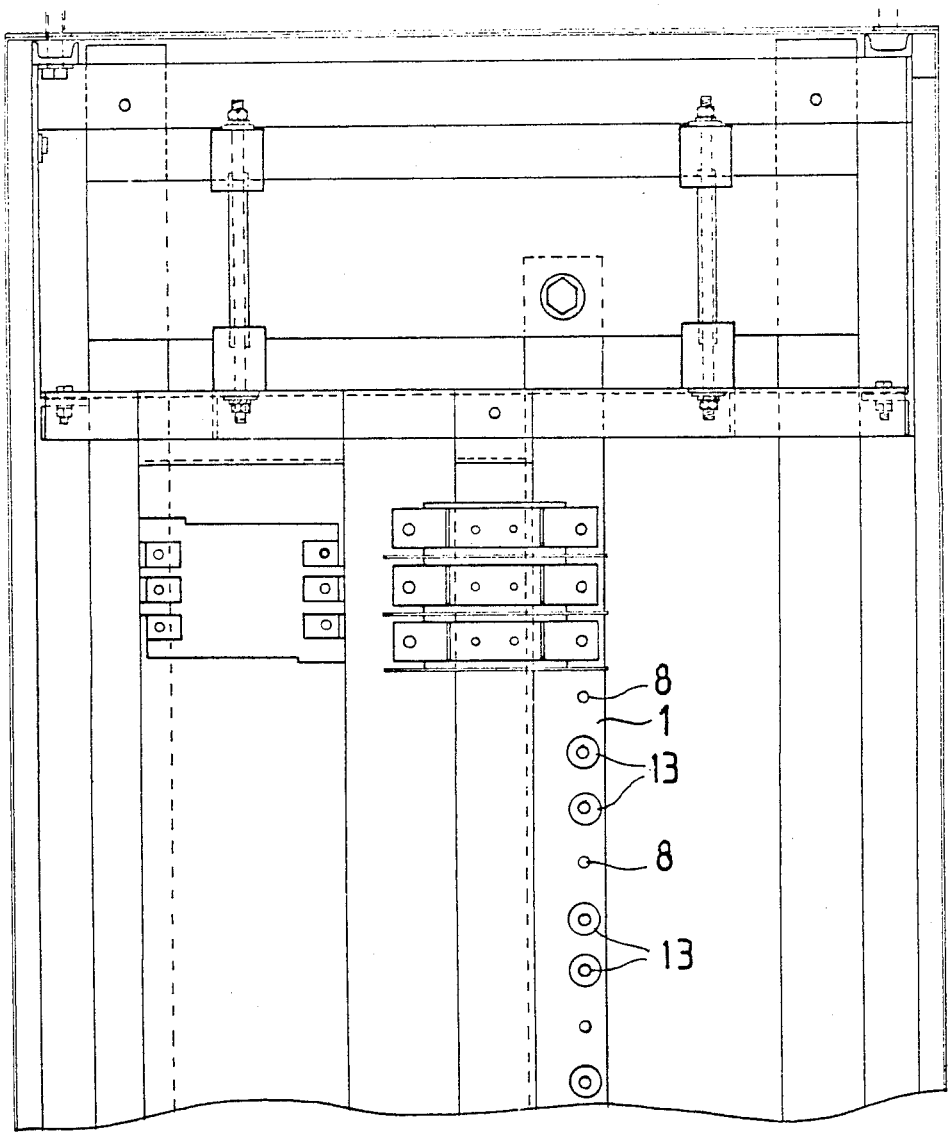
FIG. 2 is a partial elevational view of the connection device of FIG. 1, the bars being devoid of intermediate connection elements.
Figure 3:
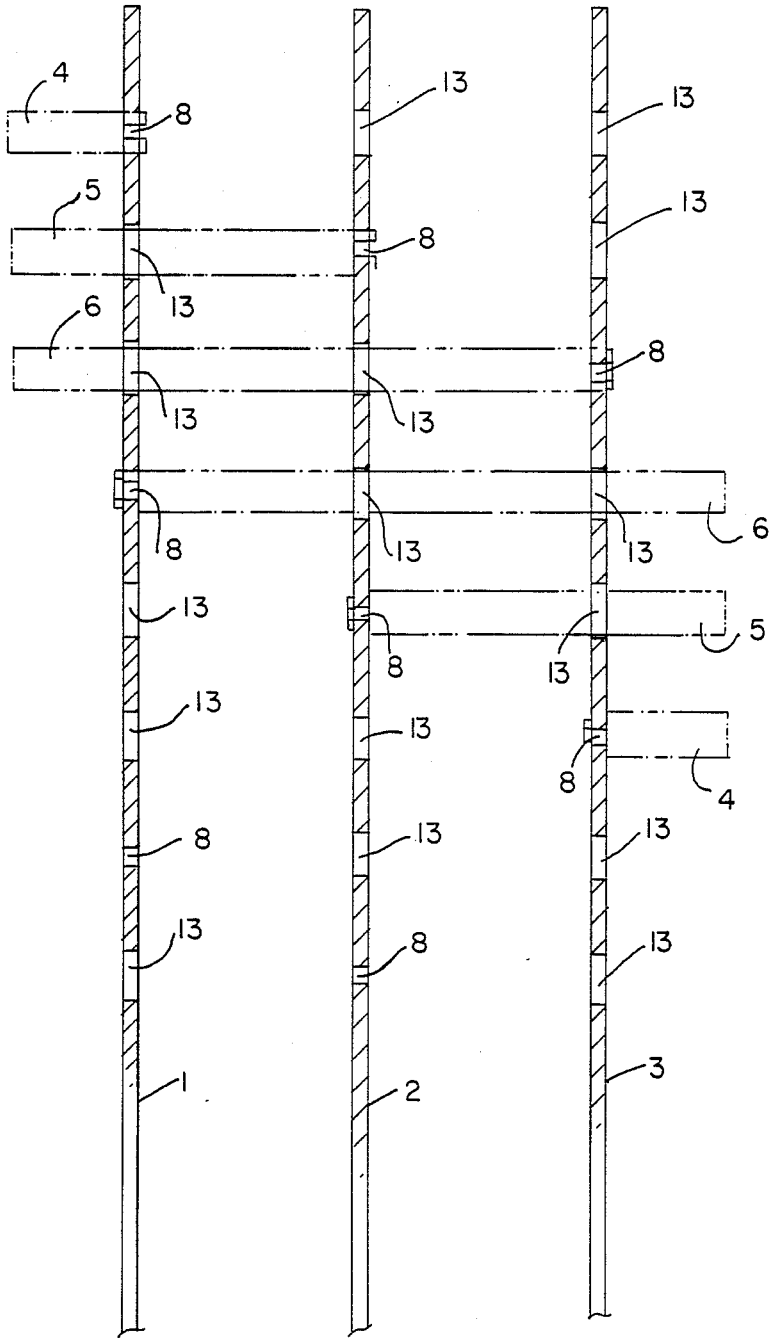
FIG. 3 is an elevational section showing arrangements of holes in conductors.

The electric onnection device according to the invention represented in FIGS. 1–3 is adapted to supply electric current to any utilizer apparatus which may be connected to a set of vertical bars of any number, for example three bars in the described embodiment, namely bars 1, 2 and 3. The bars are separated by air gaps and extend in a direction parallel to one another and they are disposed one behind the other, the bar 1 being the front or the first bar of the succession of bars. The electric connection of the bars 1, 2, 3 to any electric utilizer apparatus (not shown) is achieved by respective intermediate connection elements 4, 5 and 6 which extend horizontally, i.e. perpendicularly to the planes of the bars 1, 2 and 3.

Each intermediate connection element 4, 5, 6 is fixed, at its rear end, to the corresponding bar 1, 2, 3 by a screw 7. This screw 7 extends through a hole 8 of small diameter drilled in the bar and it is screwed into a tapped hole provided in the rear end part of an internal tube 9, composed of an electrically conductive material, for example brass, of the intermediate connection element. This conductive tube 9 is covered with a sleeve 11 of insulating material which constitutes a protective sheath. Further, each of the intermediate connection elements 4, 5, 6 carries, at its front end, a connector member 12 of any known type which engages a respective cable that is electrically connected directly to the upstream side of the utilizer apparatus.

The first intermediate connection element 4 is fixed to the first, or front bar 1 by the respective screw and extends forwardly from bar 1.

The second intermediate connection element 5 which is fixed to the second or intermediate bar 2 and which is located below the first intermediate connection element 4, also extends forwardly and passes through a hole 13 drilled in the first front bar 1 below the fixing hole 8 for the first intermediate connection element 4. This hole 13 has a diameter which is larger than that of the hole 8 and which corresponds to the outside diameter of the insulating sleeve 11. The second intermediate connection element 5 has a length greater than that of the first intermediate connection element 4 by the distance between the first two bars 1, 2 so that its front end, i.e. its connector member 12, is contained in a vertical plane parallel to the bars 1, 2, 3 passing through the front connector member 12 of the first intermediate connection element 4.

Likewise, the third intermediate connection element 6, which is positioned below second element 5, is fixed at its rear end to the third bar 3 by a screw 7 extending through a hole 8 of small diameter, and it extends through the first and second bars 1 and 2 by passing through holes 13 which are in horizontal alignment with each other and with the hole 8 drilled in the third bar 3. The third intermediate connection element 6 has a length greater than that of the second intermediate element 5 by the distance between the second and third bars 2, 3, so that its front connector member 12 is located below the connector members 12 of the other two intermediate connection elements 4 and 5 located thereabove.

It is seen that, with the foregoing arrangement, the three connector members 12 provided at the front ends of the three intermediate connection or branch elements 4, 5 and 6 are located one above the other in front of the device, which permits easy access thereto for positioning connection cables.

With reference again to FIG. 3, it is seen that the conductors 1, 2 and 3 have a plurality of series of holes 8, 13, so that the electric connection device permits the connection to the conductors in the form of bars 1 to 3 of as many utilizer devices as the conductors 1 to 3 have series of holes provided therein.

It is adantageous to make the conductors 1 to 3 all similar to the conductor 1, from a conductive bar, for example of copper, in which are drilled holes 8 of small diameter and holes 13 of larger diameter, so that each hole 8 of small diameter is followed by two holes 13 of larger diameter, and to cut the conductors 1 to 3 in such manner that the first series of holes located at the upper end of the first conductor 1 is formed by a hole 8 of small diameter followed by two holes 13 of larger diameter, the series of holes corresponding to the second conductor 2 being formed by a hole 13 of larger diameter followed by a hole 8 of small diameter and by a hole 13 of larger diameter, and the series of holes corresponding to the third bar 3 being formed by two holes 13 of larger diameter followed by a hole 8 of small diameter.

Thus it is possible to use for the three conductors 1 to 3 a standard bar which still further simplifies the manufacture of the connection device of the invention. Further, such an arrangement permits the branch-connection of a utilizer apparatus on each side of the connection device, which may be of interest for the implantation of the equipment to be supplied with current.

In the connection device according to the invention, the conductors 1, 2 and 3 are bare and are disposed at such distances that their mutual insulation is achieved by air with no necessary to interpose between the conductors separation elements of insulating material.

Lastly, the presence of the intermediate connection elements extending through the conductors 1, 2 and 3 ensures that the connection device according to the invention has good mechanical characteristics, in particular with respect to electrodynamic forces, as compared to connection devices of conventional construction.

Figure 4:
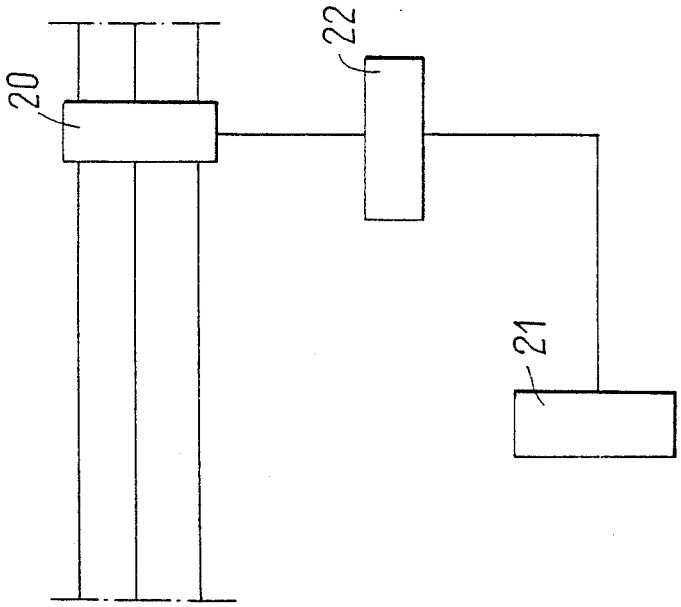
FIG. 4 is an electric diagram showing the function of a limiter of current surges of the electric connection device according to the invention.

In FIG. 4, there is shown an electric diagram of a supply circuit of a utilizer device connected to the network by means of an electric connection device according to the invention.

The electric connection device 20 according to the invention is connected to a three-phase network in the manner described with reference to FIGS. 1–3.

A utilizer device 21 is connected to the connection device through a circuit breaker 22. It has been found that the device of the invention presents a high impedance in the event of a short-circuit produced in the utilizer device.

It was in particular possible to observe that the short-circuit current downstream of the connection device 20 was as little as one quarter of the short-circuit current which would exist in the circuit if a conventional electric distribution device were used.

This phenomenon is attributed to a large impedance of the connection device of the invention which occurs in the event of transient phenomena such as the production of a short-circuit brought about by the occurrence of an operational defect in the utilizer device 21.

This increased impedance of the electric connection device according to the invention is due to the original construction of this device and probably is produced by the crossings between the connection bars with the network and the intermediate connection elements passing therethrough.

Consequently, the use of the electric connection device just described opens up very interesting prospects in the field of the reduction in sizing of the protecting device to be inserted in the utilization circuit between the connection device and the electric load or loads connected to the network through this connection device.

Indeed, the fact that the electric connection device according to the invention ensures a large limitation in the short-circuit currents permits the positioning between the device and the loads of a protection device of reduced power and consequently of lower cost, which enables the cost of supply installations to be considerably reduced.

I claim:

1. A prefabricated electric connection apparatus comprising:

a plurality of conductor bars including a first bar, at least one intermediate bar and a last bar, said bars extending parallel to each other and being separated by air gaps, and said bars being positioned one behind the other in a direction perpendicular to the planes of said bars;

at least one group, equal in number to said plurality of bars, of intermediate connection elements, each said connection element having an external insulating sheath, and each said connection element having opposite front and rear ends;

means for removably connecting said rear end of each said connection element with a respective one of said bars such that all of said connection elements extend in the same plane in parallel directions perpendicular to said bars;

at least said bars other than said first bar having therethrough holes through which extend one or more said connection elements, including said insulating sheaths thereof, except said connection element connected to said last bar; and said front ends of all of said connection elements being located beyond said last bar at a side thereof opposite the other said bars.

2. An apparatus as claimed in claim 1, wherein said front ends of all of said connection elements are located in the same plane extending parallel to said planes of said bars.

3. An apparatus as claimed in claim 2, wherein said connection elements all have different lengths, the difference in length of two connection elements connected to two adjacent said bars being equal to the distance between said two bars.

4. An apparatus as claimed in claim 1, wherein each said connection element comprises an internal tube formed of an electrically conductive material and a sleeve of insulating material covering said tube and forming said insulating sheath, said tube having in the rear end thereof a tapped hole, each said bar has therethrough a small diameter hole, and said connection means comprises screws extending through said small diameter holes in said bars and into said tapped holes in respective said tubes.

5. An apparatus as claimed in claim 4, wherein said front end of each said connection element has a respective connector member for providing electrical contact with a cable to lead to a utilizer apparatus.

6. An apparatus as claimed in claim 4, wherein each said bar has therethrough a plurality of successive series of holes, each said series of holes comprising a said small diameter hole followed by a numberof said connection element-receiving holes equal to said plurality of bars less one, and said series of holes of each said bar being shifted longitudinally thereof by one hole relative to the series of said holes of an adjacent said bar.

7. An apparatus as claimed in claim 1, defining a limiter of short-circuit surge current in a load connected to a supply network by said apparatus.

* * * * *

UNITED STATES PATENT AND TRADEMARK OFFICE

CERTIFICATE OF CORRECTION

PATENT NO. : 4,815,985

DATED : March 28, 1989

INVENTOR(S) : Daniel J. CHAPOTIER

It is certified that error appears in the above-identified patent and that said Letters Patent is hereby corrected as shown below:

On the Abstract page, the Assignee information should read:

--[73] Assignee: Fournitures Electro Techniques, Saint Just en Chaussee, France, part interest--

Signed and Sealed this

Twenty-third Day of October, 1990

*Attest:*

HARRY F. MANBECK, JR.

*Attesting Officer*

*Commissioner of Patents and Trademarks*